US006931680B2

(12) United States Patent
Bellick et al.

(10) Patent No.: US 6,931,680 B2
(45) Date of Patent: Aug. 23, 2005

(54) SLEEPING BAG WITH STRETCHABLE PANELS

(75) Inventors: Michael M. Bellick, Saint Louis, MO (US); Linda S. Baugh, Saint Charles, MO (US); John H. Wright, Weldon Spring, MO (US); Alain R. Denis, Georgetown, TX (US)

(73) Assignee: American Recreation Products, Inc., St. Louis, MO (US)

( * ) Notice: Subject to any disclaimer, the term of this patent is extended or adjusted under 35 U.S.C. 154(b) by 0 days.

(21) Appl. No.: 10/821,688

(22) Filed: Apr. 9, 2004

(65) Prior Publication Data

US 2005/0034235 A1 Feb. 17, 2005

Related U.S. Application Data

(60) Provisional application No. 60/494,683, filed on Aug. 13, 2003.

(51) Int. Cl.[7] ..... A47G 9/08

(52) U.S. Cl. ..... 5/413 R; 5/486; 5/494; 2/695

(58) Field of Search ..... 5/486, 494, 413 R; 2/69.5, 83

(56) References Cited

U.S. PATENT DOCUMENTS

| | | | | |
|---|---|---|---|---|
| 1,811,821 | A | 6/1931 | Bloom | 2/69 |
| 2,234,546 | A | 3/1941 | Basch | 2/69.5 |
| 2,284,900 | A | 6/1942 | Henderson et al. | |
| 2,341,069 | A | 2/1944 | Anderson | |
| 2,578,323 | A | 12/1951 | Sillaway | 2/69.5 |
| 2,598,462 | A | 5/1952 | Strauss | 2/69.5 |
| 2,622,248 | A | 12/1952 | Schaye | 2/80 |
| 2,948,278 | A | 8/1960 | Topa | 128/873 |
| 3,787,906 | A | 1/1974 | Hunt | |
| D230,455 | S | 2/1974 | Hunt | |
| 3,831,206 | A | 8/1974 | Geary | |
| 3,857,125 | A | 12/1974 | Hunt | |
| 3,959,834 | A | 6/1976 | Hunt | |
| 4,033,001 | A | 7/1977 | Kern | |
| 4,079,472 | A | 3/1978 | Maguire | |
| 4,158,892 | A | 6/1979 | Gonzales | |
| 4,507,805 | A | 4/1985 | Calutoiu | |
| 4,884,303 | A | 12/1989 | Scherer | |
| 4,888,828 | A | 12/1989 | Tatsuno | |
| 4,989,282 | A | 2/1991 | Goldstein | |
| 5,222,257 | A | 6/1993 | Bachor | |
| 5,386,602 | A | 2/1995 | Krenzler | |
| 5,473,779 | A | 12/1995 | Kramer | |
| 5,657,497 | A | 8/1997 | Howe | |
| 5,669,088 | A | 9/1997 | McNamee | |
| D405,585 | S | 2/1999 | Stevens | |
| 5,881,405 | A | 3/1999 | Garrigues | |
| 5,960,492 | A | 10/1999 | Byrne | |
| 5,966,756 | A | 10/1999 | Cartier | |
| 6,018,830 | A | 2/2000 | Howe | |
| 6,073,282 | A | 6/2000 | Leeper et al. | |
| 6,175,976 | B1 | 1/2001 | Cantwell | |
| 6,292,961 | B1 | 9/2001 | Ganio et al. | |
| 6,438,774 | B1 | 8/2002 | Michaelis et al. | |
| 6,449,787 | B1 | 9/2002 | Thorne | |
| 6,718,577 | B2 | 4/2004 | Li | 5/482 |

FOREIGN PATENT DOCUMENTS

| | | |
|---|---|---|
| CA | 2183114 A1 | 2/1998 |
| GB | 2 229 351 A | 9/1990 |

*Primary Examiner*—Robert E. Pezzuto
*Assistant Examiner*—Tara L. Mayo
(74) *Attorney, Agent, or Firm*—Senniger Powers

(57) ABSTRACT

A sleeping bag comprising an elongate shell defining a volume sized and shaped to receive a user therein. The shell has an inner layer, an outer layer, insulation between the inner layer and the outer layer, an overlying portion, an underlying portion, a head end, a foot end and left and right lateral sides. The outer layer has stretchable and non-stretchable panels. The stretchable panels are of resilient sheet material and are located in areas of the outer layer corresponding to the shoulders, elbows and knees of the user.

20 Claims, 3 Drawing Sheets

SLEEPING BAG WITH STRETCHABLE PANELS

CROSS REFERENCE TO RELATED APPLICATION

This application claims the benefit of U.S. Provisional Application No. 60/494,683, filed Aug. 13, 2003, titled SLEEPING BAG WITH STRETCHABLE PANELS.

BACKGROUND OF THE INVENTION

This invention relates generally to sleeping bags, and more specifically to a sleeping bag with at least one stretchable panel comprising at least part of its outer layer.

Consumers face a difficult task in finding a sleeping bag that is both thermally efficient and comfortable. Mummy bags, which generally minimize internal volume, are shaped with a lateral taper to approximately contour the body of a user. These bags effectively conserve heat by decreasing air movement within the bag. As a result, mummy-type sleeping bags are well suited for use in outdoor, cold ambient temperatures. A drawback to mummy bags is that some people feel discomfort because the relatively snug fit of these bags reduces their range of motion making them feel confined. The feeling of discomfort is typically heightened if parts of the user's body that are often moved, especially during sleep, such as the shoulders, elbows and knees, are confined.

Rectangular-type sleeping bags are shaped with a generally constant lateral dimension and provide generally a larger range of motion. Although rectangular bags are generally more spacious than mummy bags, a drawback is that their larger internal volumes make them thermally inefficient. As a result, rectangular bags are well suited for use indoors or in milder outdoor temperatures. When used in colder environments, users of rectangular bags can more easily become chilled, especially toward their feet.

Unfortunately, no single sleeping bag is available that is both thermally efficient and permits relative freedom of movement, particularly in the regions of the bag corresponding to the shoulders, knees and elbows of a user.

SUMMARY OF THE INVENTION

Among the several objects and features of the present invention may be noted the provision of a sleeping bag that is thermally efficient while still allowing relative freedom of movement; the provision of such a sleeping bag which is constructed to allow freedom of movement in areas corresponding to the knees and/or shoulders and/or elbows of a user; and the provision of such a sleeping bag which is constructed to be comfortable for a user.

In general, a sleeping bag of the present invention has at least one stretchable panel of resilient sheet material adapted for resilient deformation when stretched outwardly by a user. The sleeping bag comprises an elongate shell defining an inner volume sized and shaped to receive a user. The elongate shell has a head end, a foot end and opposite sides extending longitudinally of the shell. The shell further comprises an inner layer, an outer layer, and insulating material between the inner layer and the outer layer. The outer layer has at least one stretchable panel of resilient sheet material adapted for resilient deformation when stretched outwardly by a user in said inner volume.

In another aspect, a sleeping bag comprises an elongate shell defining an inner volume sized and shaped to receive a user. The elongate shell has opposite sides extending longitudinally of the shell, an inner layer, and an outer layer. The outer layer comprises stretchable zones defined by stretchable sheet material and non-stretchable zones defined by non-stretchable sheet material.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF PREFERRED EMBODIMENTS

Figure 1:
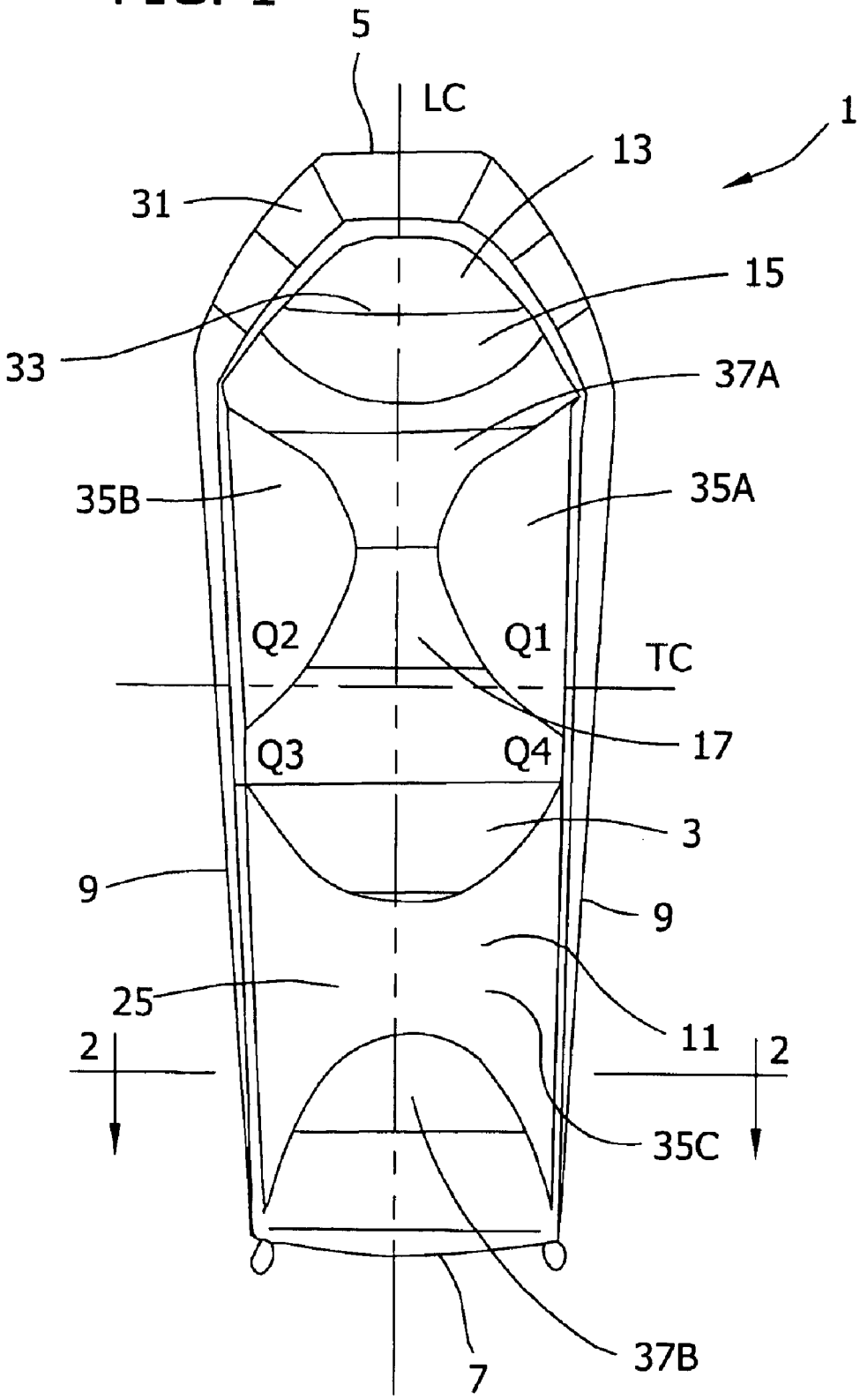
FIG. 1 is a plan view of a sleeping bag of the present invention having stretchable panels comprising part of its outer layer.
Figure 3:
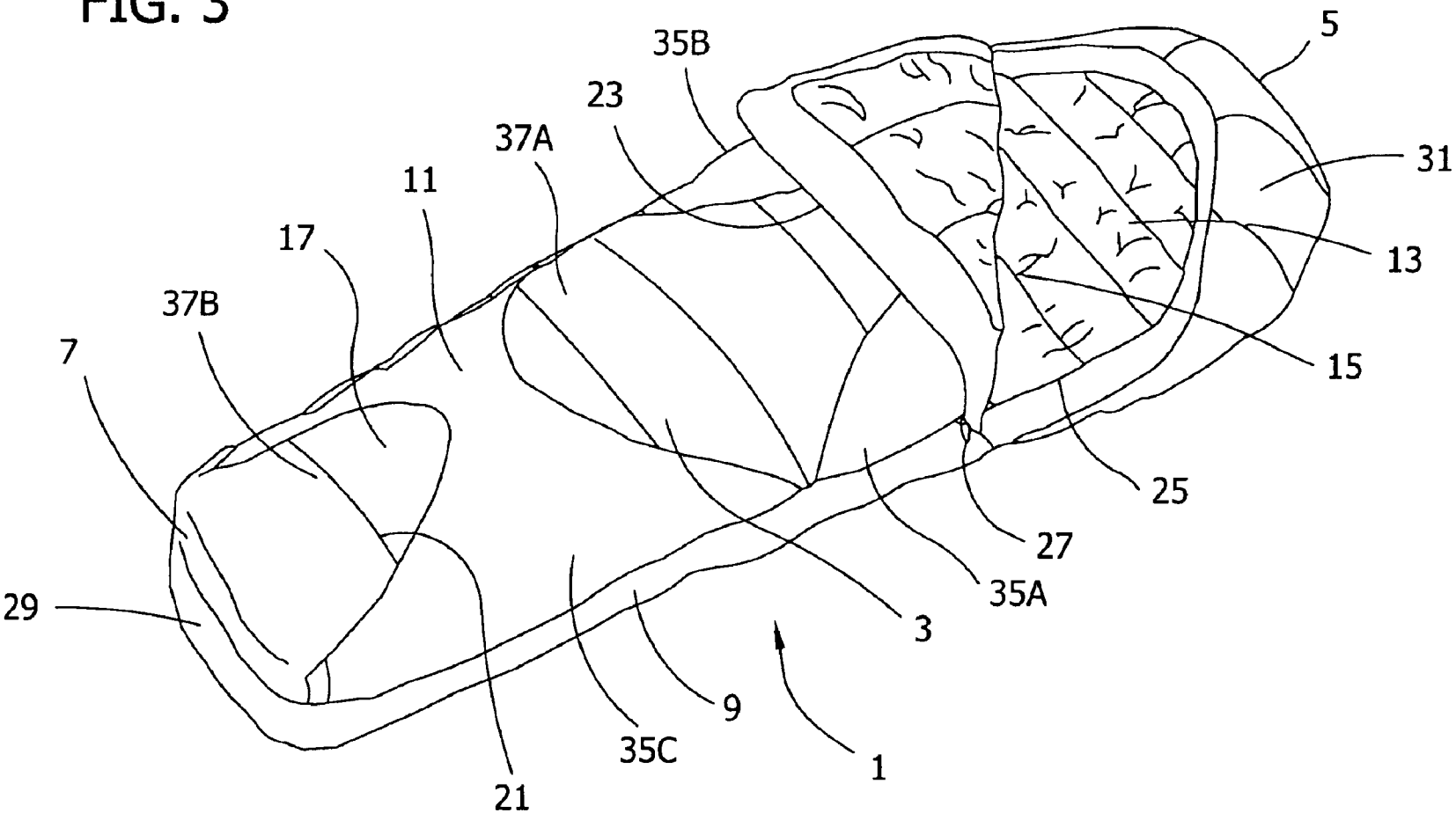
FIG. 3 is a perspective view of the sleeping bag having an overlying portion partially separated from an underlying portion to allow easy entry and exit by a user.

Referring now to the drawings and in particular to FIGS. 1 and 3, one embodiment of a sleeping bag of the present invention is designated in its entirety by the reference number 1. The sleeping bag 1 comprises an elongate shell 3 that defines an inner volume sized and shaped to receive a user therein. The shell 3 has a head end 5, a foot end 7 and opposite sides 9 extending longitudinally of the shell. In addition, the shell 3 has an overlying portion 11 which overlies the user and an underlying portion 13 which underlies the user to provide padding between the user and an underlying surface. In the embodiment of FIG. 1, the shell 3 tapers toward the foot end 7 of the shell to generally conform to the contours of the user, being broadest in the region corresponding to the shoulders of the user and narrowest or tapered in the region corresponding to the feet of the user. The tapered shell 3 provides the user a snug fit. By generally conforming to the contours of the user and substantially receiving the user, air movement within the sleeping bag 1 is minimized thus making the bag thermally efficient.

Figure 2:
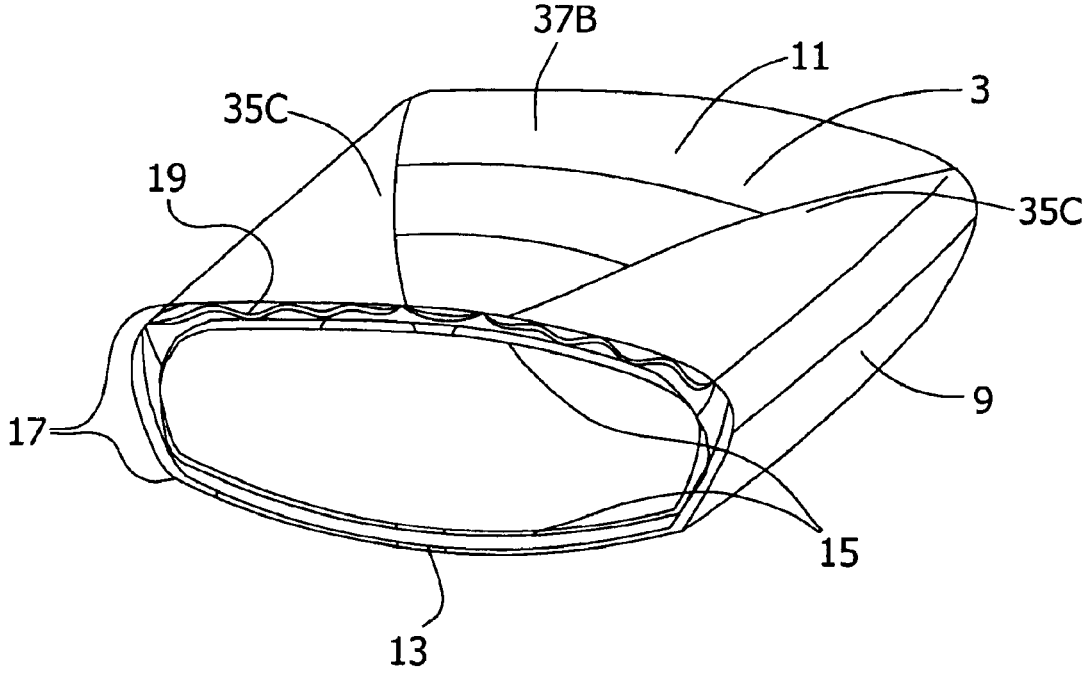
FIG. 2 is a sectional view taken on line 2—2 of FIG. 1.

As shown in FIG. 2, the shell 3 has an inner layer 15, an outer layer 17 and insulation material 19 disposed between the inner and outer layers. The outer layer 17 of the shell 3 defines the exterior of the shell and has lateral rows of stitching 21 for joining the shell to the internal insulation material 19. The inner layer 15, which desirably comprises a stretchable material, defines the inner volume of the shell 3 and is adapted for encompassing a user occupying the sleeping bag 1. Non-stretchable material may be used for the inner layer 15 without departing from the scope of the invention. The insulation material 19, which is located between the inner and outer layers 15, 17, provides warmth and softness to the bag 1. Advantageously, the insulation material 19 in the overlying portion 11 of the shell 3 is attached to the inner and outer layers 15, 17 of the shell using offset stitch-lines. The offset stitch-lines penetrate only the inner layer 15 or the outer layer 17 and thereby inhibit the entry of ambient air into the inner volume of the shell 3 along the stitch-lines. In one embodiment, the insulation material 19 is not stitched to the stretchable panels 35.

The overlying and underlying portions 11, 13 are hingely attached along the left side of the shell 3 and have free edges 23, 25 along at least a portion of the right side of the shell. It is understood that the overlying and underlying portions 11, 13 may be hingely attached to the right side of the shell 3 and have free edges 23, 25 along the left side of the shell without departing from the scope of this invention. In one embodiment, the free edges 23, 25 of both the overlying and underlying portions 11, 13 extend from the head end 5 of the shell 3 towards the foot end 7 of the shell approximately two-thirds the overall shell length. A pair of zipper tracks (not shown) are attached to the shell 3, one track being attached along the free edge 23 of the overlying portion 11 and the other track attached along the free edge 25 of the underlying portion 13. A slide fastener 27 selectively joins the zipper tracks to provide for partial separation of the overlying portion 11 from the underlying portion 13, allowing easy entry and exit by the user.

Optionally, the shell 3 may further comprise an end panel 29 located at the foot end 7 of the sleeping bag 1. The end panel 29 is stitched into the shell 3 at the foot end 7 between the overlying portion 11 and underlying portion 13. The end panel 29 provides vertical expansion of the shell 3 adjacent the foot end 7 thus adding inner volume to the region adapted for receiving the feet of a user. Another optional feature is a hood 31 located at the head end 5 of the shell 3. The hood 31 is adapted to receive the head of a user to provide warmth. A drawstring (not shown) attached along the periphery of the hood 31 allows the user to selectively open and close a face opening 33.

In accordance with the present invention, the outer layer 17 of the sleeping bag 1 comprises at least one stretchable panel 35 and one or more panels 37 of non-stretchable material in areas bordering the at least one stretchable panel. In the embodiment shown in the drawings, three stretchable panels are provided. A first stretchable panel 35A is located adjacent one side of the shell 3 in an area corresponding to one (left) shoulder and elbow of a user. A second stretchable panel 35B is located adjacent an opposite side of the shell in an area corresponding to the opposite (right) shoulder and elbow of the user. A third stretchable panel 35C is located in an area generally corresponding to the left and right knees of the user and extends from adjacent one side of the shell to adjacent the opposite side of the shell. In general, each stretchable panel defines what may be referred to as a stretchable zone, and each non-stretchable panel defines what may be referred to as a non-stretchable zone. The stretchable panels 35A–C are of resilient sheet material, such as LYCRA® material sold by E. I. du Pont de Nemours and Co. of Wilmington, Del. The material resiliently deforms when stretched outwardly by a user to provide greater freedom of movement. The non-stretch panels can be of any conventional non-stretch material suitable for use in sleeping bags. Advantageously, the insulating material 19 (FIG. 2) has a greater volume in areas corresponding to the stretchable panels 35 and is not stitched to the stretchable panels to accommodate stretching.

Referring to FIG. 1, it will be observed that the shell 3 has a transverse centerline TC defining upper and lower halves of the shell 3 and a central longitudinal centerline LC defining first (left) and second (right) longitudinal halves of the shell 3. Thus, the two centerlines divide the shell into quadrants designated Q1, Q2, Q3 and Q4. In the particular embodiment of FIG. 1, the first stretchable panel corresponding to the left shoulder and elbow is located substantially entirely within quadrant Q1 and is generally semi-circular in shape, curving inward from a respective side of the shell toward the longitudinal centerline LC. The second stretchable panel corresponding to the right shoulder and elbow are located substantially entirely within quadrant Q2 and is also generally semi-circular in shape, curving inward from a respective side of the shell toward the longitudinal centerline LC. The first and second panels 35A, 35B are separated by an upper non-stretchable panel 37A having the shape of an hour-glass oriented longitudinally of the shell. The third stretchable panel 35C is located in the lower half of the shell 3 substantially in quadrants Q3 and Q4. The panel 35C spans from adjacent one side of the shell to adjacent the opposite side of the shell and has the general shape of an hour-glass oriented transversely of the shell, extending approximately the length of the lower half of the shell 3 at locations adjacent opposite sides of the shell and a shorter length at a location generally midway between opposite sides 9 of the shell. The third stretchable panel 35C is bordered along its upper edge by the upper non-stretchable panel 37A and along its lower edge by a lower non-stretchable panel 37B at the foot end of the shell. The stretchable and non-stretchable panels 35, 37 are suitably attached, as by stitching.

Although the stretchable panels 35 have been described as being in areas generally corresponding to the shoulders, elbows and knees of the user, it will be understood that the stretchable panels could be located in only one such area, or any combination of such areas, or in other areas of the bag without departing from the scope of this invention. The stretchable (and non-stretchable) panels could also assume different shapes and have different dimensions. For instance, the stretchable panels may extend a shorter or longer distance along the length of the shell than shown in FIG. 1. Further, the stretchable panels need not be on the overlying portion 11 of the sleeping bag but may be anywhere on the outer layer 17 of the bag 1.

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description and shown in the accompanying drawings shall be interpreted as illustrative and not in a limiting sense.

What is claimed is:

1. A sleeping bag comprising an elongate shell defining an inner volume sized and shaped to receive a user therein, the elongate shell having a head end, a foot end, opposite sides extending longitudinally of the shell, an inner layer, an outer layer comprising a plurality of stretchable panels of resilient sheet material adapted for resilient deformation when stretched outwardly by a user in said inner volume, and insulating material between the inner layer and the outer layer, said plurality of stretchable panels including a first stretchable panel located adjacent one side of the shell in an area corresponding to a left shoulder and elbow of a user in said inner volume, a second stretchable panel located adjacent an opposite side of the shell in an area corresponding to a right shoulder and elbow of said user, and at least a third stretchable panel located in an area generally corresponding to the knees of the user and extending from adjacent one side of the shell to adjacent the opposite side of the shell.

2. A sleeping bag comprising an elongate shell defining an inner volume sized and shaped to receive a user therein, the elongate shell having a transverse centerline defining an upper half of the shell and a lower half of the shell, a central longitudinal centerline defining a first longitudinal half of the shell and a second longitudinal half of the shell, a head end, a foot end, opposite sides extending longitudinally of the shell, an inner layer, an outer layer comprising at least one stretchable panel of resilient sheet material adapted for resilient deformation when stretched outwardly by a user in said inner volume, and insulating material between the inner layer and the outer layer, the at least one stretchable panel comprising a first stretchable panel located entirely within the upper half of the shell and within the first longitudinal half of the shell and extending from one side of the shell toward said longitudinal centerline, and a second stretchable panel located entirely within the upper hall of the shell and within the second longitudinal half of the shell and extending from the opposite side of the shell toward said longitudinal centerline.

3. The sleeping bag as set forth in claim 2 wherein said shell further comprises an overlying portion adapted to overlie said user and an underlying portion adapted to underlie said user, and wherein the first and second stretchable panels are located in the overlying portion between the opposite sides of the shell.

4. The sleeping bag as set forth in claim 3 wherein the first and second stretchable panels are located in areas of the shell generally corresponding to shoulders and elbows of the user.

5. The sleeping bag as set forth in claim 3 wherein the insulation material in the overlying portion of the shell is attached to the inner and outer layers of the shell using offset stitch-lines, said offset stitch lines penetrating only one of the inner layer and outer layer and thereby inhibiting the entry of ambient air into the inner volume of the shell along the stitch-lines, and wherein the insulation is not stitched to the stretchable panels.

6. The sleeping bag as set forth in claim 1 wherein the at least one stretchable panel further comprises a third stretchable panel located in an area of the shell generally corresponding to at least one knee of the user.

7. The sleeping bag as set forth in claim 6 wherein the third stretchable panel extends from one side of the shell to an opposite side of the shell over an area generally corresponding to two knees of the user.

8. The sleeping bag as set forth in claim 2 wherein the outer layer further comprises non-stretchable material in areas bordering the at least one stretchable panel.

9. The sleeping bag as set forth in claim 2 wherein the inner layer of the shell comprises a stretchable material.

10. The sleeping bag as set forth in claim 2 wherein the insulating material between the inner layer and the outer layer of the shell has a greater volume in areas corresponding to the stretchable panels to accommodate stretching.

11. The sleeping bag as set forth in claim 2 wherein the shell tapers toward the foot end of the shell to provide the user a snug fit.

12. The sleeping bag as set forth in claim 2 wherein the at least one stretchable panel further comprises a third stretchable panel located in the lower half of the shell spanning from adjacent one side of the shell to adjacent the opposite side of the shell, said third panel extending approximately the length of the lower half of the shell adjacent opposite sides of the shell and extending a shorter length generally midway between opposite sides of the shells.

13. A sleeping bag comprising an elongate shell defining an inner volume sized and shaped to receive a user therein, the elongate shell having a head end, a foot end, opposite sides extending longitudinally of the shell, an inner layer, an outer layer comprising at least one stretchable panel of resilient sheet material adapted for resilient deformation when stretched outwardly by a user in said inner volume, insulating material between the inner layer and the outer layer, an overlying portion adapted to overlie said user, and an underlying portion adapted to underlie said user, the at least one stretchable panel being located in the overlying portion between the opposite sides of the elongate shell, the insulation material in the overlying portion of the elongate shell being attached to the inner and outer layers of the shell using offset stitch-lines, said offset stitch-lines penetrating only one of the inner layer and outer layer and thereby inhibiting the entry of ambient air into the inner volume of the shell along the stitch-lines, and wherein the insulation is not stitched to the at least one stretchable panel.

14. The sleeping bag as set forth in claim 13 wherein the at least one stretchable panel comprises a pair of stretchable panels located adjacent opposite sides of the shell in areas generally corresponding to shoulders and elbows of the user.

15. The sleeping bag as set forth in claim 13 wherein the at least one stretchable panel comprises a plurality of stretchable panels located in areas of the shell generally corresponding to shoulders, elbows and knees of the user.

16. The sleeping bag as set fort in claim 15 wherein the at least one stretchable panel comprises a first stretchable panel located adjacent one side of the shell in an area corresponding to a left shoulder and elbow of a user in said inner volume, a second stretchable panel located adjacent an opposite side of the shell in an area corresponding to a right shoulder and elbow of said user, and at least a third stretchable panel located in an area generally corresponding to the knees of the user and extending from adjacent one side of the shell to adjacent the opposite side of the shell.

17. The sleeping bag as set forth in claim 13 wherein the shell has a transverse centerline defining an upper half of the shell and a lower half of the shell and a central longitudinal centerline defining a first longitudinal half of the shell and a second longitudinal half of the shell.

18. The sleeping bag as set forth in claim 17 wherein the at least one stretchable panel is located in the lower half of the shell and spans from adjacent one side of the shell to adjacent the opposite side of the shell, and wherein the panel extends approximately the length of the lower half of the shell adjacent opposite sides of the shell and extends a shorter length generally midway between opposite sides of the shells.

19. The sleeping bag as set forth in claim 13 wherein the insulating material has a greater volume in areas corresponding to the at least one stretchable panel to accommodate stretching.

20. The sleeping bag as set forth in claim 13 wherein the shell tapers toward the foot end of the shell to provide the user a snug fit.

* * * * *

UNITED STATES PATENT AND TRADEMARK OFFICE

CERTIFICATE OF CORRECTION

PATENT NO. : 6,931,680 B2
DATED : August 23, 2005
INVENTOR(S) : Bellick et al.

It is certified that error appears in the above-identified patent and that said Letters Patent is hereby corrected as shown below:

Column 5,
Line 29, “stitch lines” should read -- stitch-lines --.
Line 34, “claim 1” should read -- claim 2 --.

Column 6,
Line 29, “fort” should read -- forth --.

Signed and Sealed this

Twenty-first Day of March, 2006

JON W. DUDAS
*Director of the United States Patent and Trademark Office*